US005752339A

United States Patent [19]

Bentley et al.

[11] Patent Number: 5,752,339

[45] Date of Patent: May 19, 1998

[54] RECOIL SYSTEM FOR THE BUTT STOCK OF A FIREARM

[76] Inventors: James K. Bentley, 2489 Starling Dr., Paso Robles, Calif. 93446; Willard H. Crawford, 1836 Orange St., Bakersfield, Calif. 93004

[21] Appl. No.: 794,760

[22] Filed: Feb. 3, 1997

[51] Int. Cl.[6] ..... F41C 23/00

[52] U.S. Cl. ..... 42/74; 42/73

[58] Field of Search ..... 42/73, 74, 71.01

[56] References Cited

U.S. PATENT DOCUMENTS

| | | | |
|---|---|---|---|
| 3,209,482 | 10/1965 | Kuzma et al. | 42/74 |
| 3,754,344 | 8/1973 | Spiliotis | 42/74 |
| 4,663,877 | 5/1987 | Bragg | 42/74 |
| 5,031,348 | 7/1991 | Carey | 42/74 |
| 5,392,553 | 2/1995 | Carey | 42/73 |

*Primary Examiner*—Michael J. Carone
*Assistant Examiner*—Matthew J. Lattig

[57] ABSTRACT

A recoil system for the butt stock of a firearm having a recoil suppressor assembly whose front end is mounted in the cavity in the rear end of the butt stock. The piston ram of the recoil suppressor assembly in its static position extends rearwardly into a bore hole cavity of an elongated recoil housing. When the firearm is shot, the elongated body portion of the recoil suppressor assembly and its transversely extending mounting flange portion instantaneously travel rearwardly into the bore hole cavity with the bore hole of the body housing reciprocally traveling over the piston ram. A coil spring whose front end is secured to the front end of the body portion and whose rear end is secured to a cam assembly returns the elongated body portion to its static position once the recoil of the firearm has been suppressed.

7 Claims, 2 Drawing Sheets

RECOIL SYSTEM FOR THE BUTT STOCK OF A FIREARM

BACKGROUND OF THE INVENTION

The invention relates to firearms and more specifically to a recoil system for the butt stock of a firearm.

One of the age old problems that has existed with firearms is the fact many of them have a severe recoil that affects the person firing the weapon. In firearms such as shotguns and rifles, the rear end of the butt stock is positioned against the shooters shoulder and the recoil often causes the shooter to raise the front of the firearm each time the weapon is fired. Also the amount of recoil varies depending upon the amount of explosive in the shell being fired and the recoil can result in pain and or bruising to the firer's shoulder area. One example of the recoil being detrimental to a firer's accuracy is when the firearm is a shotgun being used for skeet shooting either by a man or a woman.

The best art recoil systems for the butt stock of a firearm have been very expensive and the inexpensive systems do not function properly. Two examples of expensive systems are a hydro-coil fluid dampening system and a pneumatic air chamber system. The present day inexpensive recoil systems utilize compression springs to absorb the recoil forces. If the compression spring is a little to-strong, you get more recoil than with a regular firearm. If the compression spring is not strong enough it is worse, in that it gives the gun some travel and it is the same as holding the butt stock too loosely.

It is an object of the invention to provide a novel recoil system for the butt stock of that minimizes the amount of recoil force experienced by the person firing the weapon.

It is also an object of the invention to provide a novel recoil system for the butt stock of a firearm that minimizes pain to the shoulder of the person firing the weapon due to recoil forces.

It is another object of the invention to provide a novel recoil system for the butt stock of a firearm that requires no modification to the butt stock.

It is a further object of the invention to provide a novel recoil system for the butt stock of a firearm that is economical to manufacture and market.

It is also an object of the invention to provide a novel recoil system for the butt stock of a firearm that is easily mounted to the rear end of a conventional but stock.

SUMMARY OF THE INVENTION

The recoil system for the butt stock of a firearm is installed in the rear end cavity of a conventional butt stock. The existing recoil pad is removed and set aside for later assembly. A recoil suppressor assembly is then attached to the open end of the butt stock. Attached over the rear end of the recoil suppressor assembly is a rubber recoil housing and to its rear wall is then attached the previously removed recoil pad.

The recoil suppressor assembly has an elongated body portion with a mounting flange portion extending transversely adjacent its rear wall. The rear wall of the elongated body portion has a longitudinally extending bore hole within which is reciprocally received a piston ram. The rear end of the piston ram extends into the bore hole cavity of the recoil housing approximately 1½ inches. The rear end of the piston ram has a pair of laterally spaced threaded bore holes that receive screws that are inserted through aligned bore holes in the rear walls of the recoil housing.

In its static position the piston rams extends from the rear end of the elongated body portion approximately 1½ inches.

As the firearm is shot, the recoil transmitted through the butt stock will drive the butt stock and the elongated body portion rearwardly causing it and the transversely mounting flange portion to travel rearwardly in the bore hole cavity of the recoil housing. After the butt stock has reached its rearward most position, the coil spring structure will return the elongated body portion to its initial forward static position.

The elongated coil spring is mounted externally of the elongated body portion. Its front end is secured to a pin or retainer secured to the front end of the elongated body portion. The rear end of the coil spring is connected to the front end of the front lever arm. The rear end of the front lever arm is pivotally secured to the bottom end of the rear lever arm. The rear lever arm is positioned substantially vertically in an aperture in the mounting flange portion of the body portion and it pivots about a hinge pin positioned intermediate its top and bottom ends. A roller cam is mounted on the top end of the rear lever arm and it is captured in a cavity in the bottom wall of the piston ram. When the recoil action takes place, the mounting flange portion travels rearwardly thereby causing the roller cam on the top end of the rear lever arm to travel forwardly in the cavity in the bottom wall of the piston ram. After the recoil force has been dissipated, the coil spring causes the rear lever arm to be pivoted clockwise so that the elongated body portion returns to its static position.

DESCRIPTION OF THE PREFERRED EMBODIMENT

Figure 1:
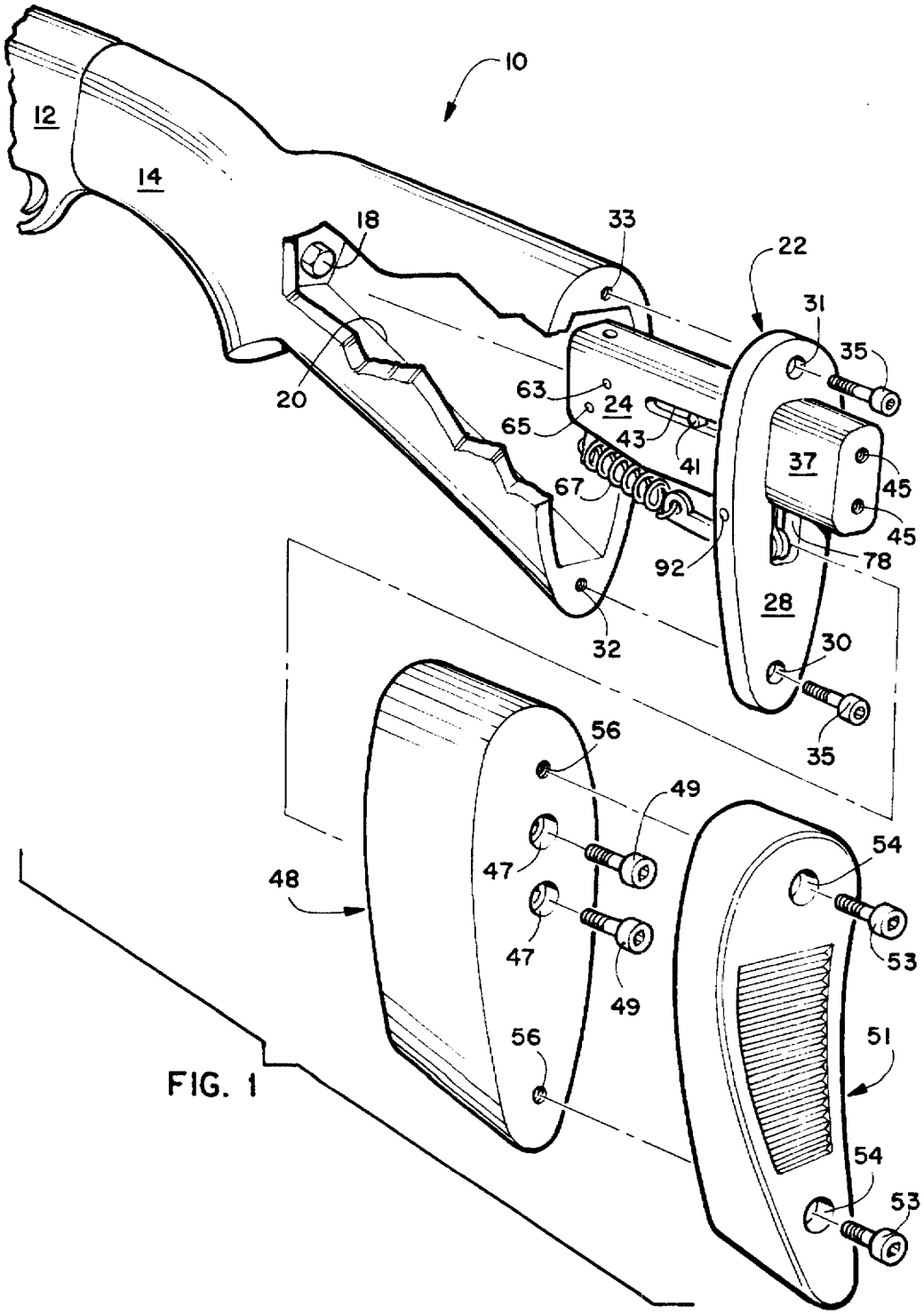
FIG. 1 is an exploded perspective view of the recoil system and the manner in which it is secured to the rear end of the butt stock of a firearm.

The novel recoil system for the butt stock of a firearm will now be described by referring to FIGS. 1–4 of the drawings. In FIG. 1, a firearm 10 (which is normally a shotgun or a rifle) has a receiver 12, and a conventional butt stock 14. Butt stock 14 has a bore hole 16 through which is inserted the shank of a bolt 18 whose front end is threadably secured to the rear end of receiver 12. Cavity 20 receives recoil suppressor assembly 22.

Recoil suppressor assembly 22 has an elongated body portion 24 having an X-axis. Body portion 24 has a front wall 26 and a rear wall 27. A mounting flange portion 28 extends transversely to the elongated body portion 24. A bottom bore hole 30 and a top bore hole 31 align with respective threaded bore holes 32 and 33 in the rear end of butt stock 14 and a pair of screws 35 detachably secure the mounting flange portion 28 to butt stock 14.

A piston ram 37 extends rearwardly from rear wall 27 a predetermined distance D1 which is approximately 1½ inches. The front end of piston ram 37 is reciprocally received in bore hole 39 of body portion 24. There is a transversely extending bore hole 41 in piston ram 37 and a pin 42 is inserted therein and its outer end is captured in a slot 43 in the side wall of body portion 24 thereby allowing the piston ram 34 to travel reciprocally forward and backward in bore hole 39. The rear wall of piston ram 37 has a pair of threaded bores 45 that align with bore holes 47 in recoil housing 48 and screws 49 secure the two members together. Recoil pad 51 which originally had been removed from the rear of butt stock 14 is then secured by screws 53 passing through bore holes 54 in recoil pad 51 and then threadably received in threaded bore holes 56 in recoil housing 48.

The front end of body portion 24 has a slot 58 for receiving a reversible retainer 60. Reversible retainer 60 has a pair of vertically spaced pin apertures 62 for removably receiving connecting pins 63. By reversing the orientation of reversible retainer 60, either a short spring or a long spring may be utilized depending upon the need for shells having either high or low base powder charges. This provides approximately 1½ inch adjustment for spring changes. Connecting pins 63 would also pass through aligned respective apertures 65 in the opposite side walls of body portion 24.

A coil spring 67 has its front end inserted into aperture 68 at the bottom end of reversible retainer 60. A cam assembly 70 has a front lever arm 72 and a rear lever arm 73 that are pivoted together by a pin 74. Lever arm 72 has an aperture 76 formed in its front end for receiving the rear end of coil spring 67. Rear lever arm 73 in its static position normally has its bottom end received within aperture 78 in rear wall 28 and its top end received in cavity 80 in the bottom wall of piston ram 37. A roller cam 82 is mounted on a pin 83 passing through the top end of rear lever arm 73.

Figure 2:
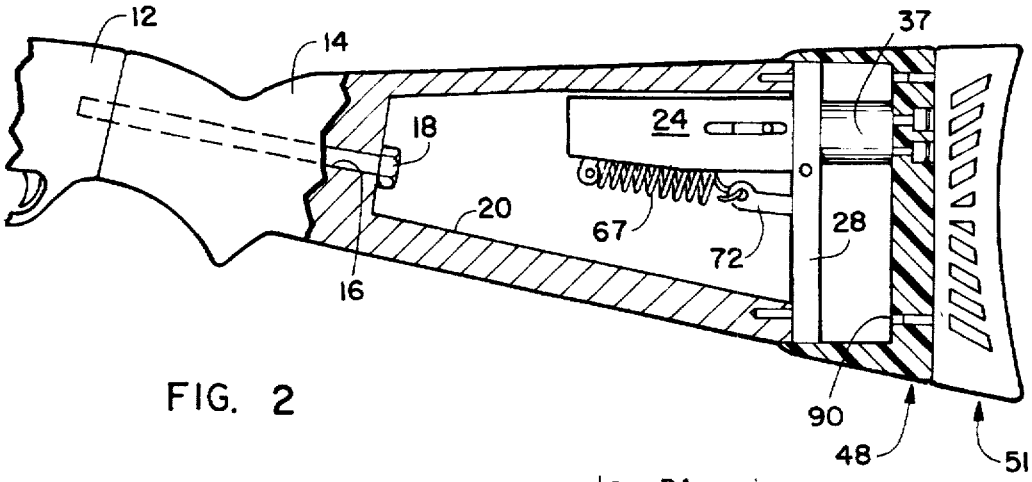
FIG. 2 is a side elevation view with portions shown in cross section illustrating the recoil system secured to the rear end of the butt stock of the firearm.
Figure 3:
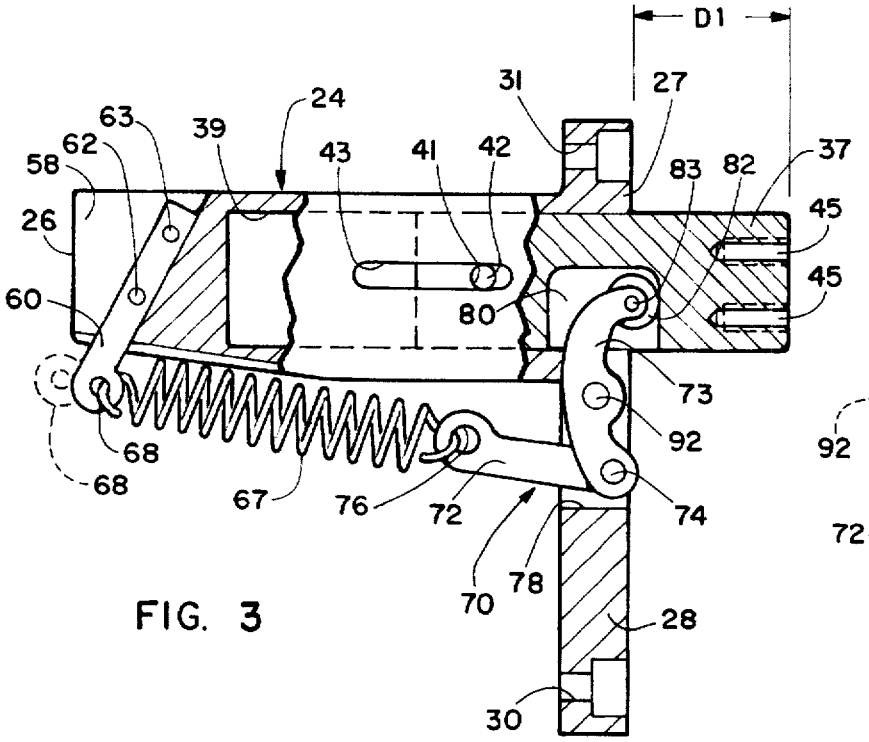
FIG. 3 is an enlarged side elevation c ross sectional view of the recoil suppressor assembly.
Figure 4:
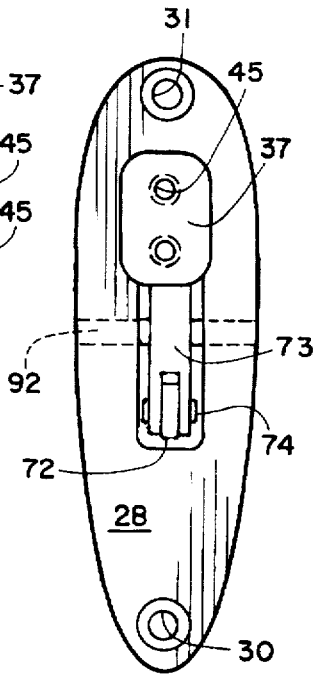
FIG. 4 is a rear elevation view of the recoil suppressor assembly.

The manner in which the novel recoil system functions starts with the piston ram in its static position illustrated in FIG. 2. When the weapon is fired, the recoil of the butt stock causes it to travel rearward until the rear wall of mounting flange portion 28 has reached the front surface of the bore hole cavity 90 in recoil housing 48. As this is occurring, elongated body portion 28 has also traveled rearwardly so that the front end of piston ram 37 approaches the front end of bore hole 39. Rear lever arm 73 at the same time is pivoting around hinge pin 92 and roller cam 82 is traveling around the inner surface of cavity 80. Once the recoil force has been dampened or eliminated, coil spring 67 pulls front lever arm 72 forward and causes rear lever arm 73 to rotate clockwise back to its original static position.

What is claimed is:

1. A recoil system for the butt stock of a firearm comprising:

a coil suppressor assembly having an elongated body portion having a longitudinally extending X-axis; said body portion having a front end and a rear wall; a primary bore hole is formed in said rear wall and it extends forwardly a predetermined distance along said X-axis; said primary bore hole having a predetermined cross sectional configuration; an elongated piston ram reciprocally mounted in said primary bore hole and it has a cross sectional configuration that mates with the shape of said primary bole hole; said piston ram having a front end, a rear end and a bottom wall; wherein when the piston ram is in a static position, the rear end of the piston ram extends a predetermined distance from the rear end of said housing portion;

means for removably securing said recoil suppressor assembly to the rear end of a conventional butt stock of a firearm; and an elongated recoil housing having a front end and a rear end; said front end having a bore hole cavity configured to momentarily receive a rear end of a firearm butt stock as it travels rearwardly once a firearm has been fired.

2. A recoil system for the butt stock of a firearm as recited in claim 1 further comprising a conventional recoil pad and means for detachably securing it to the rear end of said recoil housing.

3. A recoil system for the butt stock of a firearm as recited in claim 1 further comprising means for securing said recoil housing to the rear end of said piston ram.

4. A recoil system for the butt stock of a firearm as recited in claim 3 wherein said means for securing said recoil housing to the rear end of said piston ram comprises at least one threaded bore hole in the rear end of said piston ram and it is aligned with a bore hole that extends from the bore cavity in said recoil housing to its rear end and a screw inserted therein is removably engaged in the threaded bore hole of said piston ram.

5. A recoil system for the butt stock of a firearm as recited in claim 1 further comprising an elongated coil spring having a front end and a rear end and said coil spring is positioned externally of said body portion; said front end of said coil spring being detachably secured to the front end of said body portion; a cam assembly having a rear lever arm that is pivotally secured to the rear end of a front lever arm; said front lever arm being detachably secured to the rear end of said compression spring; said piston ram having a roller cam cavity formed in its bottom wall that receives a roller cam mounted on the top end of said rear lever arm.

6. A recoil system for the butt stock of a firearm as recited in claim 5 wherein said elongated body portion has a transversely extending mounting flange portion and it has an aperture for receiving said rear lever arm; said rear lever arm being pivotally mounted on a pin mounted in said aperture of said mounting flange portion.

7. A recoil system for the butt stock of a firearm as recited in claim 1 further comprising means for detachably securing said piston ram in said body portion.

* * * * *